United States Patent [19]

Ruger et al.

[11] 4,000,575

[45] Jan. 4, 1977

[54] MEANS FOR RETRACTION OF LOWER FIRING PIN OF OVER-AND-UNDER FIREARM

[75] Inventors: William B. Ruger, Southport; Lawrence L. Larson, Bethany, both of Conn.

[73] Assignee: Sturm, Ruger & Co. Inc., Southport, Conn.

[22] Filed: May 8, 1975

[21] Appl. No.: 575,804

[52] U.S. Cl. ..... 42/44
[51] Int. Cl.[2] ..... F41C 11/10
[58] Field of Search ..... 42/44, 45, 41, 42 R, 42/43

[56] References Cited

UNITED STATES PATENTS

| | | | |
|---|---|---|---|
| 326,986 | 9/1885 | Hyde | 42/45 |
| 1,578,638 | 3/1926 | Browning | 42/42 R |
| 2,376,358 | 5/1945 | Horsrud | 42/45 |
| 3,389,488 | 6/1968 | Beretta | 42/42 R |

*Primary Examiner*—Charles T. Jordan
*Attorney, Agent, or Firm*—Pennie & Edmonds

[57] ABSTRACT

Over-and-under firearms of the break-open type have an upper barrel and a lower barrel secured together and pivotally mounted on the frame of the firearm. A top lever is rotatably mounted on the frame for retaining the barrels at their closed position when the top lever is at its barrel locking position and for releasing the barrels for rotation to their open position when the top lever is rotated to its barrel unlocking position. Upper and lower firing pins and springs are mounted for longitudinal movement on the frame, and upper and lower hammers and springs pivotally mounted on the frame. The spring loaded hammers press the firing pins forwardly when the hammers are at their forward or fired position so that the forward ends of the firing pins extend into the rearward ends of the upper and lower barrels. The top lever is provided with a hammer and firing pin retracting cam that is positioned to permit the lower hammer to contact and press the lower firing pin forwardly when the top lever is at its barrel locking position and to move the lower hammer and lower firing pin rearwardly when the top lever is rotated from its barrel locking position to its barrel unlocking position, thereby withdrawing the lower firing pin from the rearward end of the lower barrel.

4 Claims, 10 Drawing Figures

MEANS FOR RETRACTION OF LOWER FIRING PIN OF OVER-AND-UNDER FIREARM

BACKGROUND OF THE INVENTION

1. Field of the Invention

This invention relates to over-and-under firearms of the break-open type, and in particular to means for retracting the lower firing pin from contact with a cartridge contained in the lower barrel when the firearm is being broken open.

2. Prior Art

Over-and-under firearms of the break-open type to which the present invention relates include rifles, shotguns and combinations thereof. Such firearms have a frame and an upper and a lower barrel which are secured together and are pivotally mounted on the frame, the barrels being rotatable from their closed ready-to-fire position to their open loading-and-unloading position. A top level is rotatably mounted on the frame for retaining the barrels at their closed position when the top lever is at its barrel locking position and for releasing the barrels for rotation to their open position when the top level is rotated to its barrel unlocking position. Upper and lower firing pins are mounted for longitudinal movement on the frame in position to strike the primer cap of a cartridge (or shotgun shell) contained in the upper and lower barrels, respectively, upper and lower firing springs urging the firing pins rearwardly out of contact with the cartridges contained in the barrels of the firearm. Upper and lower hammers are pivotably mounted on the frame in position to strike the upper and lower firing pins, respectively, the hammers being rotatable from their rearward cocked positions to their forward fired positions at which they are in contact with the upper and lower firing pins of the firearm. Upper and lower sears releasably retain the upper and lower firing pins at their cocked positions, and upper and lower hammer springs drive the upper and lower hammers forwardly against the upper and lower firing pins when the upper and lower sears are disengaged from the hammers by the trigger mechanism of the firearm.

When the firearm is in its ready-to-fire condition, the barrels are at their closed position, the top lever is at its barrel locking position, the upper and lower hammers are retained at their rearward cocked positions by the upper and lower sears, and the upper and lower firing pins are at their rearward positions out of contact with the cartridges contained in the upper and lower barrels, respectively, of the firearm. When the firearm is fired by pulling the trigger, the trigger mechanism first withdraws one sear (say, the upper sear) from engagement with the upper hammer to allow the upper hammer to strike the upper firing pin and drive the firing pin forcefully against the primer cap of the cartridge contained in the upper barrel. Pulling the trigger again causes the trigger mechanism to withdraw the lower sear from engagement with the lower hammer and thereby allow the lower hammer to strike the lower firing pin and drive this firing pin forcefully against the primer cap of the cartridge contained in the lower barrel of the firearm. The firing pins must strike the primer caps with sufficient force to ignite the primer material of the caps, and this causes the forward ends of the firing pins to form small but distinct depressions or indentations in the relatively soft metal of the caps. As a result, after the firearm is fired the forward ends of both the upper and lower firing pins normally are imbedded or received in the small indentations thus formed in the primer cap of each cartridge and are held in these indentations by the spring loaded hammers that bear against the rearward ends of the firing pins.

To reload the firearm it must be broken open to remove the spent cartridge cases from the upper and lower barrels and to load fresh cartridges into each barrel. To this end, the top lever is rotated from its barrel locking position to its barrel unlocking position, thereby releasing the barrels for rotation to their open loading-and-unloading position. However, rotation of the barrels to their open position may be interfered with or prevented altogether if the forward ends of the upper and lower firing pins are not somehow withdrawn from the indentations formed in the primer caps of the cartridges in the upper and lower barrels.

In most over-and-under firearms, the upper and lower hammers are disposed in side by side relationship with one hammer on each side of the longitudinal center line of the firearm. In such firearms the upper firing pin extends longitudinally upwardly and inwardly from the forward facing firing pin striking surface of the upper hammer to the primer cap of the cartridge contained in the upper barrel, and the lower firing pin extends longitudinally downwardly and inwardly from the forward facing firing pin striking surface of the lower hammer to the primer cap of the cartridge contained in the lower barrel. The upwardly angled upper firing pin does not interfere with the movement of the barrels from their closed position to their open position in that the rotational movement of the barrels tends to withdraw the indented primer cap of the cartridge in the upper barrel from contact with the upwardly angled upper firing pin. However, the downwardly angled lower firing pin does interfere with the movement of the barrels to their open position in that the rotational movement of the barrels merely serves to imbed the lower firing pin more firmly in the indentation formed in the primer cap of the cartridge in the lower barrel. As a consequence, it is necessary to provide some means for withdrawing the lower firing pin from contact with the cartridge contained in the lower barrel before the barrels are swung or rotated to their open position.

One solution to this problem has been to employ a rebound type of hammer for the lower barrel. A rebound hammer is provided with a hammer spring and strut arrangement that causes the hammer to rebound a short distance rearwardly after striking the firing pin. When struck by the hammer, the firing pin strikes the primer cap of the cartridge in the lower barrel. However, as the hammer rebounds a short distance rearwardly, the firing pin is withdrawn from contact with the indented primer cap by the firing pin spring. Another solution has been to employ an inertia type of firing pin for the lower barrel. An inertia firing pin is somewhat shorter than a standard positive contact firing pin so that, after being struck by the hammer and, in turn, striking the primer cap of the cartridge, the shorter firing pin is withdrawn from contact with the indented primer cap by the firing pin spring. This type of firing pin, however, does not always provide positive ignition of the primer cap, and, therefore, is not an ideal solution to the problem.

After an extensive investigation of the above mentioned problem, we have now devised a simple yet effective means for withdrawing or retracting the lower firing pin from contact with the cartridge contained in the lower barrel of an over-and-under firearm. The firing pin retracting means of the invention permits the use of a full length positive contact firing pin for the lower barrel and insures retraction of this firing pin from the lower barrel before the barrels are unlocked from their closed position and are free to be rotated to their open position.

SUMMARY OF THE INVENTION

Over-and-under firearms of the type to which the invention relates have a frame, and upper and lower barrels secured together and pivotally mounted on the frame for rotation from their closed ready-to-fire position to their open loading-and-unloading position. Upper and lower firing pins are mounted for longitudinal movement on the frame, the forward ends of the firing pins extending into the rearward ends of the upper and lower barrels, respectively, when the firing pins are at their forwardmost positions, the firing pins being withdrawn from the rearward ends of the upper and lower barrels when the firing pins are at their rearwardmost positions. Upper and lower hammers are pivotally mounted on the frame, the hammers bearing against the rearward ends of the upper and lower firing pins and pressing the firing pins to their forwardmost positions when the hammers are rotated to their forward positions. Upper and lower firing pin springs urge the firing pins toward their rearwardmost positions, and upper and lower hammer springs urge the hammers toward their forward positions. A top lever is pivotally mounted on the frame for rotation about its vertical axis from a barrel locking position to a barrel unlocking position, the upper and lower barrels being retained at their closed position when the top lever is at its barrel locking position and being rotatable to their open position when the top lever is at its barrel unlocking position.

Our improvement in means for retracting the lower firing pin from contact with a cartridge contained in the lower barrel comprises a hammer and firing pin retracting cam disposed on the top lever in a position that permits the lower hammer to contact and press the lower firing pin forwardly when the top lever is at its barrel locking position and in position to move the lower hammer and the lower firing pin rearwardly when the top lever is rotated from its barrel locking position to its barrel unlocking position. In one advantageous embodiment of the invention the retracting cam is positioned to contact the lower hammer and to move it rearwardly when the top lever is rotated from its barrel locking position to its barrel unlocking position, thereby permitting the lower firing pin spring to move the lower firing pin rearwardly and thus withdraw it from the rearward end of the lower barrel. In another advantageous embodiment of the invention the lower firing pin is formed with a longitudinally disposed retracting cam receiving slot. The retracting cam of the top lever is received in the cam receiving slot of the lower firing pin, the retracting cam being positioned adjacent the rearward end of the cam receiving slot when the firing pin is at its forwardmost position and the top lever is at its barrel locking position. As a result, when the top lever is rotated from its barrel locking position to its barrel unlocking position the lower firing pin and the lower hammer are moved rearwardly by the retracting cam, thereby withdrawing the lower firing pin from the rearward end of the lower barrel.

BRIEF DESCRIPTION OF THE DRAWINGS

The improvement in the firing pin retracting means of the invention will be better understood from the following description thereof in conjunction with the accompanying drawings of which.

DETAILED DESCRIPTION

Figure 1:
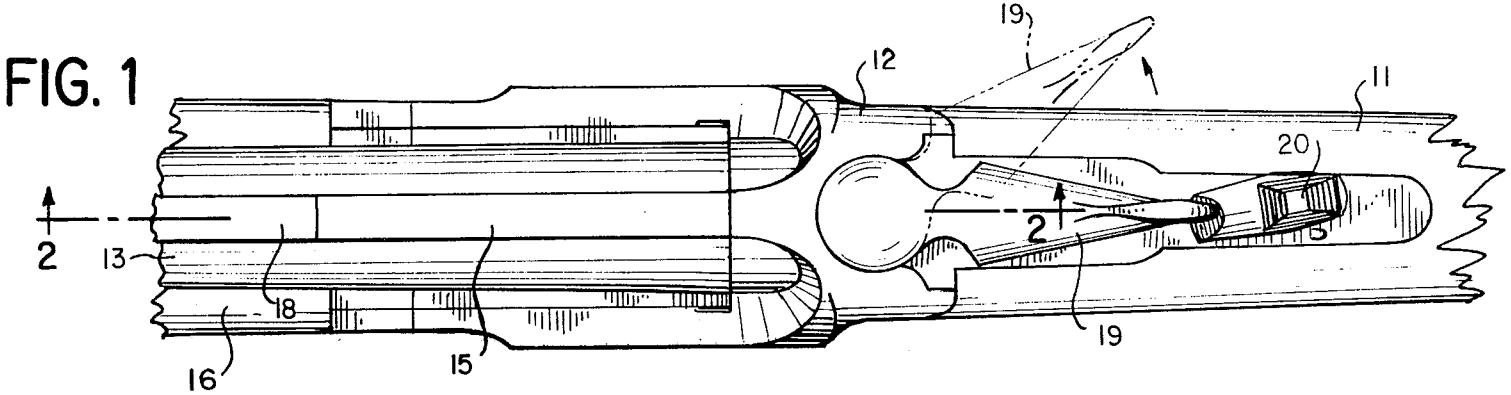
FIG. 1 is a fragmentary view from above of an over-and-under shotgun showing the frame and adjacent portions of the barrels and stock of the shotgun.
Figure 2:
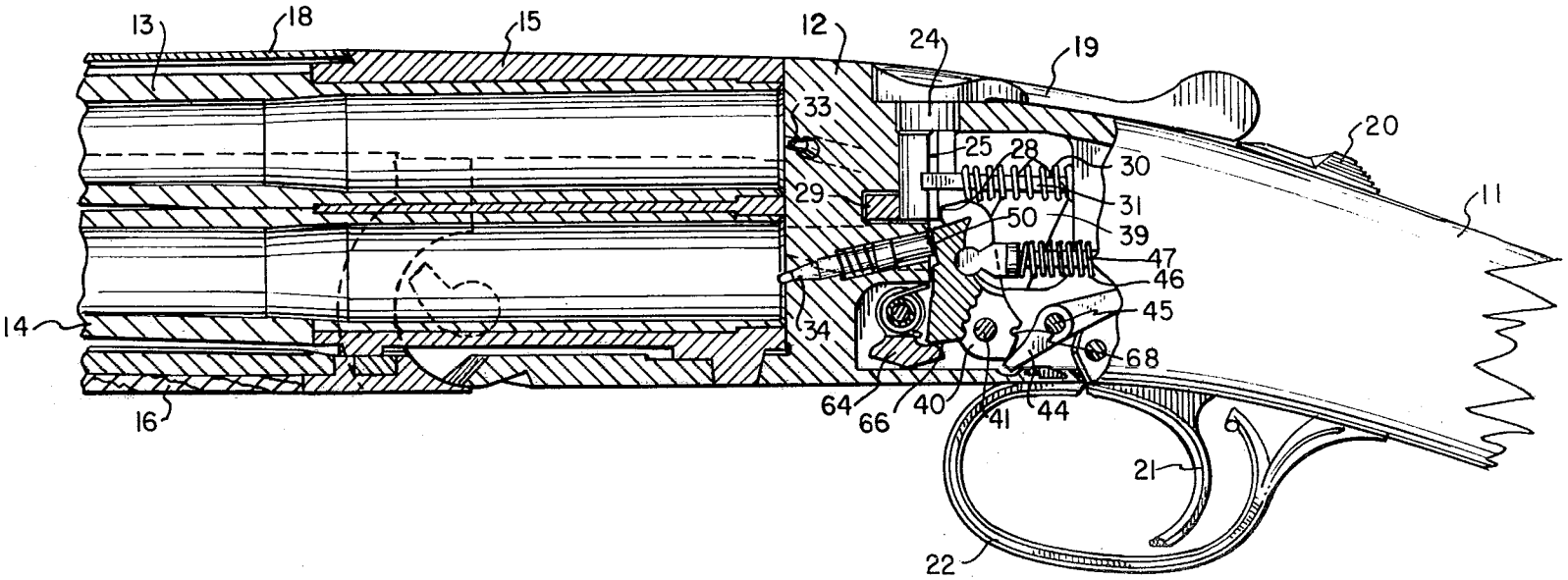
FIG. 2 is a fragmentary side elevation, partly in section along line 2—2 of FIG. 1, of the over-and-under shotgun shown in FIG. 1.

As previously mentioned, the present invention relates to over-and-under firearms of the break-open type and includes rifles, shotguns and combinations thereof. The invention will be described in conjunction with the over-and-under shotgun shown in the drawings, but is not limited to this particular firearm. As shown best in FIGS. 1 and 2 of the drawings, the over-and-under shotgun has a stock 11, a frame 12 mounted on the stock, an upper barrel 13 and lower barrel 14, a monoblock or barrel housing 15 to which the upper and lower barrels are secured, and a forearm stock 16. The barrel housing 15 and forearm stock 16 are pivotally mounted on the frame 12 so that the barrels can be rotated from their closed position (as shown in FIGS. 1 and 2) to their open position (as shown partly open in FIG. 9). A ventilated sighting rib 18 is secured to the barrel housing 15 and extends from the barrel housing to the forward end of the upper barrel 13. A top lever 19 is pivotally mounted on the frame for rotation about its vertical axis from its barrel locking position (as shown with solid lines in FIG. 1) to its barrel unlocking position (as shown with dashed lines in FIG. 1). Also mounted on the frame 12 are the safety and barrel selector 20, the trigger 21 and trigger guard 22, and the other parts of the firing mechanism hereinafter described.

Figure 10:
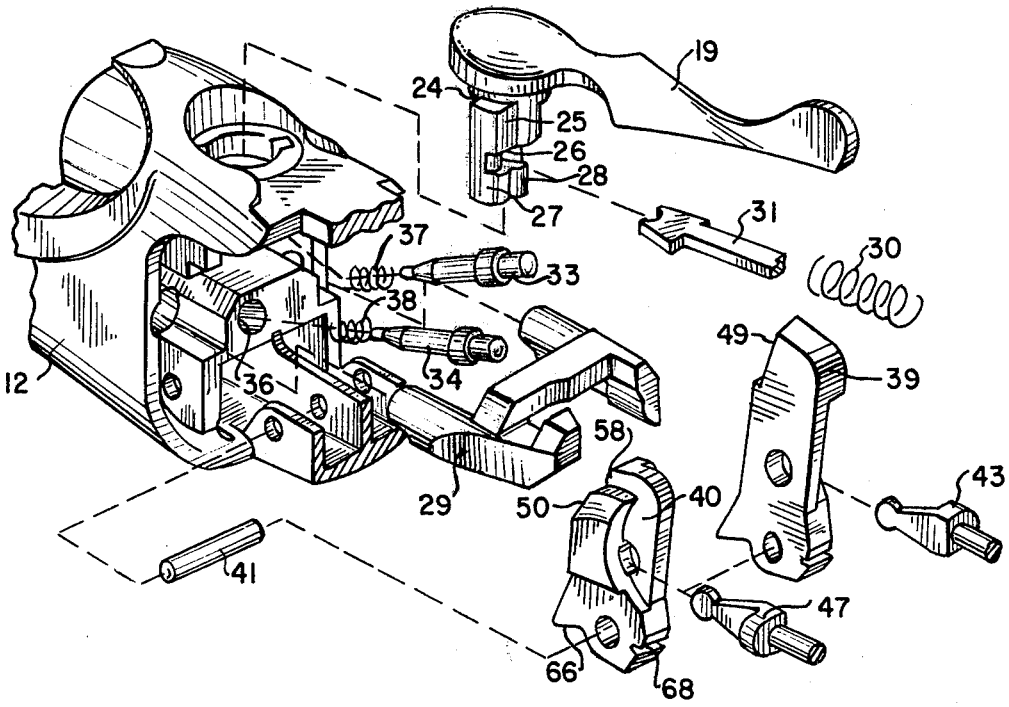
FIG. 10 is an exploded perspective view of the mechanism shown in FIGS. 2 through 6.

When the top lever 19 is rotated to its barrel locking position the upper and lower barrels 13 and 14 are releasably retained at their closed position, and when the top lever is rotated to its barrel unlocking position the barrels are free to rotate to their open position. As shown best in FIGS. 3 and 10, the top lever 19 is provided with an axial hub 24 and with a vertically disposed operating crank 25 that extends downwardly from the hub 24 and is radially offset with respect to the vertical axis of rotation of the top lever. The operating crank 25 is formed with a strut receiving notch 26, a lock bolt operating cam 27 and a hammer and firing pin retracting cam 28. A barrel lock bolt 29 (shown best in FIG. 10) is slidably mounted on the frame 12, the lock bolt 29 being engaged by the lock bolt operating cam 27 of the operating crank 25 of the top lever 19. When the top lever 19 is rotated to its barrel locking position the barrel lock bolt 29 is moved to its forward position into engagement with the barrel housing 15, thereby retaining the upper and lower barrels 13 and 14 at their closed position. When the top lever 19 is rotated to its barrel unlocking position the barrel lock bolt 29 is moved to its rearward position out of engagement with the barrel housing 15, thereby permitting the barrels 13 and 14 to be rotated to their open position. A top lever spring 30 and spring strut 31 engage the strut receiving notch 26 of the operating crank 25 of the top lever 19 and urge the top lever to its barrel locking position. The top lever 19 is retained at its barrel unlocking position against the pressure of the top lever spring 30 by a top lever detent (not shown).

An upper firing pin 33 and a lower firing pin 34 are mounted for longitudinal movement in bores 35 and 36 formed in the frame 12, the firing pins being urged to their rearwardmost position within the bores by means of the upper and lower firing pin springs 37 and 38, respectively. An upper hammer 39 and a lower hammer 40 are pivotally mounted on the frame 12 by means of the pivot pin 41 for rotation from their rearward cocked positions (as indicated by the upper hammer 39 in FIG. 2) to their forward fired positions (as indicated by the lower hammer 40 in FIG. 2). An upper hammer sear (not visible) is pivotally mounted on the frame 12 for releasably retaining the upper hammer 39 at its rearward cocked position, and an upper hammer spring and spring strut 43 urge the upper hammer 39 toward its forward fired position. Similarly, a lower hammer sear 44 is pivotally mounted on the frame 12 by means of the pivot pin 45 for releasably retaining the lower hammer 40 at its rearward cocked position, and a lower hammer spring 46 and spring strut 47 urge the lower hammer 40 toward its forward fired position.

Figure 3:
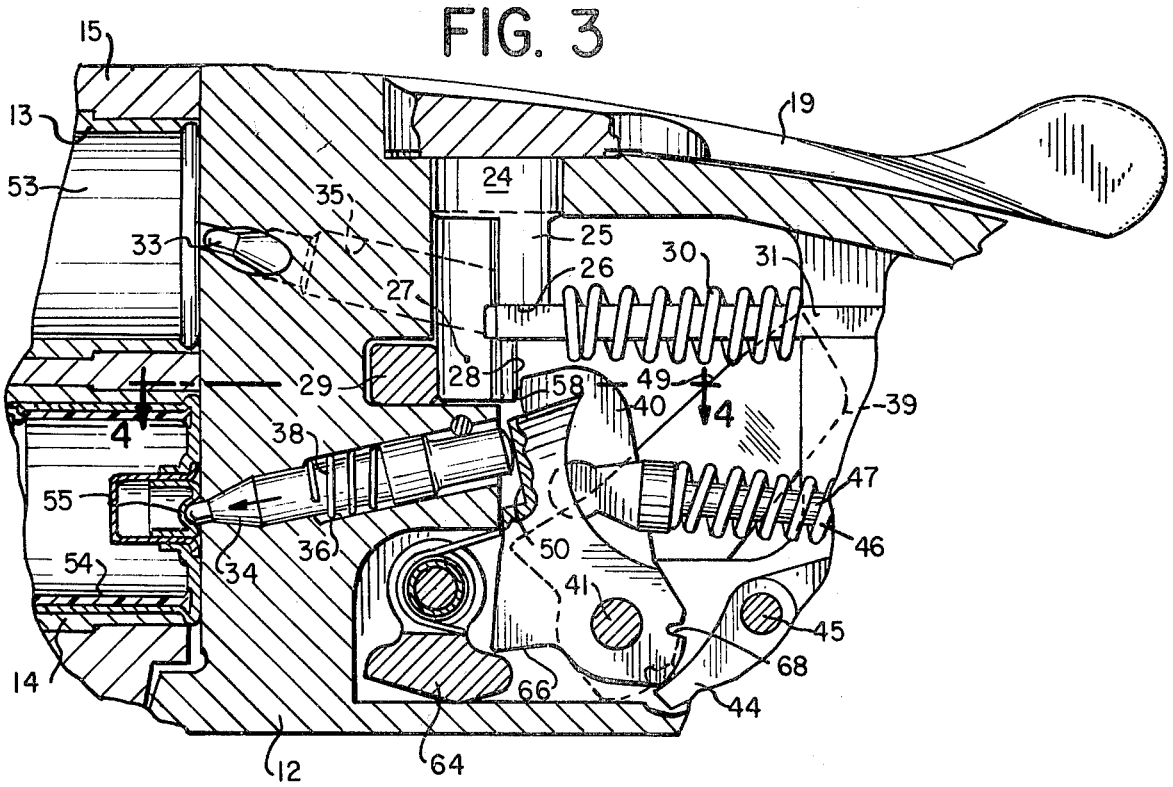
FIG. 3 is an enlarged sectional view of the central portion of FIG. 2 showing the position of the lower hammer, the lower firing pin and the retracting cam of the top lever when the top lever is at its barrel locking position.

When the hammers 39 and 40 are at their rearward cocked positions, the firing pin springs of the firing pins 33 and 34 press the firing pins to their rearwardmost positions at which the forward ends of both firing pins are withdrawn from the rearward ends of the barrels 13 and 14 out of contact with the cartridges, if any, contained in the barrels. When the hammers 39 and 40 are at their forwardmost positions the forward facing firing pin striking surfaces 49 and 50 of the hammers contact the rearward ends of the firing pins 33 and 34 and press the firing pins forwardly to their forwardmost positions at which the forward ends of the firing pins extend into the rearward ends of the barrels 13 and 14 and, therefore, into contact with the primer caps of the cartridges, if any, contained in the barrels. This is best shown in FIG. 3 in which the upper hammer 39 is at its rearward cocked position and the upper firing pin 33 is withdrawn from contact with the cartridge 53 contained in the upper barrel 13 and in which the lower hammer 40 is at its forward fired position and the lower firing pin 34 is at its forwardmost position with the forward end of the firing pin imbedded in the indentation formed in the primer cap 55 of the cartridge 54 contained in the lower barrel 14.

The upper and lower hammers 39 and 40 are pivotally mounted in side-by-side relationship with one hammer on each side of the longitudinal center line of the frame 12. (For this reason the upper and lower hammers 39 and 40 are sometimes referred to as the right hand and left hand hammers of the shotgun). The upper and lower barrels 13 and 14, on the other hand, are mounted one above the other in vertical alignment with the longitudinal center line of the shotgun. As a result, the upper firing pin 33 extends longitudinally upwardly and inwardly from the forward facing firing pin striking surface 49 of the upper (right hand) hammer 39 to the longitudinal axis of the upper barrel 13, and the lower firing pin 34 extends longitudinally downwardly and inwardly from the forward facing firing pin striking surface 50 of the lower (left hand) hammer 40 to the longitudinal axis of the lower barrel 14.

When the shotgun is in its ready-to-fire condition, the barrels 13 and 14 are at their closed position, the top lever 19 and the barrel lock bolt 29 are at their barrel locking positions, the upper and lower hammers 39 and 40 are retained at their rearward cocked positions by the upper and lower sears, and the upper and lower firing pins 33 and 34 at their rearward positions out of contact with the cartridges 53 and 54 contained in the upper and lower barrels. When the shotgun is fired by pulling the trigger 21, the trigger mechanism withdraws one sear (say, the upper sear) from engagement with the upper hammer 39, thereby allowing the upper hammer spring to drive the upper hammer 39 forcefully against the rearward end of the upper firing pin 33 and to drive the firing pin against the primer cap of the cartridge contained in the upper barrel 13. When the trigger 21 is pulled again, the trigger mechanism withdraws the other sear (say, the lower sear 44) from engagement with the lower hammer 40, thereby allowing the lower hammer spring 46 to drive the lower hammer forcefully against the rearward end of the lower firing pin 34 and to drive the firing pin against the primer cap of the cartridge contained in the lower barrel 14 of the firearm. The firing pins must strike the primer caps with sufficient force to ignite the primer material of the caps, and this causes the forward ends of the firing pins to form small but distinct depressions or indentations in the relatively soft metal of the caps. As a result, after both barrels of the shotgun are fired the forward ends of both the upper and lower firing pins 33 and 34 normally are imbedded in the small indentations thus formed in the primer cap of each cartridge and are held in these indentations by the spring loaded hammers 39 and 40 that bear against the rearward ends of the firing pins.

To reload the shotgun it must be broken open to remove the spent cartridge cases from the upper and lower barrels and to permit the insertion of fresh cartridges into each barrel. To this end, the top lever 19 is rotated from its barrel locking position to its barrel unlocking position, thereby moving the barrel lock bolt 29 to its rearward position and releasing the barrels for rotation to their open position. The upwardly angled upper firing pin 33 does not interfere with the movement of the barrels from their closed position to their open position in that the rotational movement of the barrels tends to move the indented primer cap of the cartridge in the upper barrel 13 away from contact with the upper firing pin 33. However, the downwardly angled lower firing pin 34 does interfere with the movement of the barrels to their open position in that the rotational movement of the barrels merely serves to imbed the lower firing pin 34 more firmly in the indentation formed in the primer cap of the cartridge in the lower barrel 14.

In order to prevent interference with the movement of the barrels 13 and 14 from their closed position to their open position, means must be provided for withdrawing or retracting the lower firing pin 34 rearwardly out of contact with the cartridge contained in the lower barrel 14. In the improvement in firing pin retractor means of the invention, the hammer and firing pin retractor cam 28 of the operating crank 25 of the top lever 19 is adapted to move the lower firing pin 34 and the lower hammer 40, or to cause these parts to be moved, a short distance rearwardly when the top lever is rotated from its barrel locking position to its barrel unlocking position.

Figure 4:
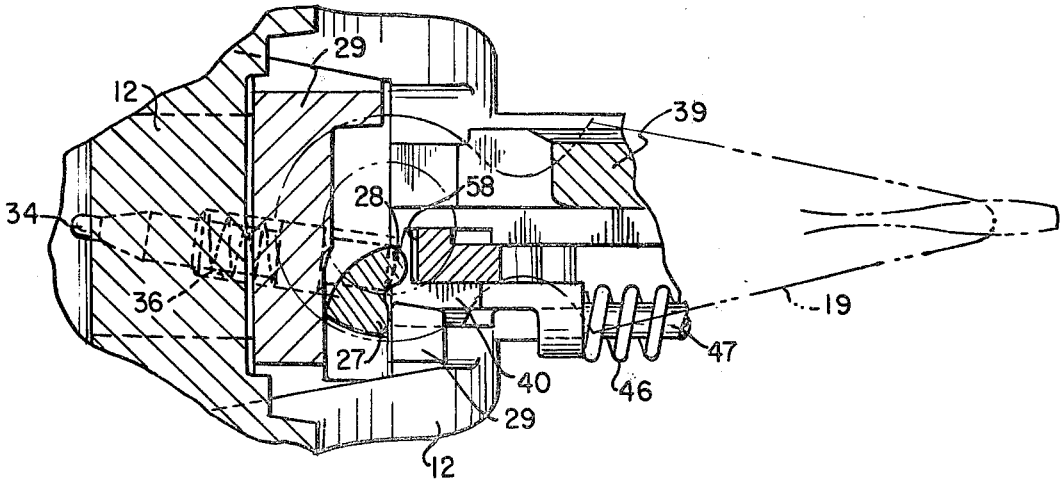
FIG. 4 is a sectional view along line 4—4 of FIG. 3 showing the position of the retracting cam when the top lever is at its barrel locking position.
Figure 6:
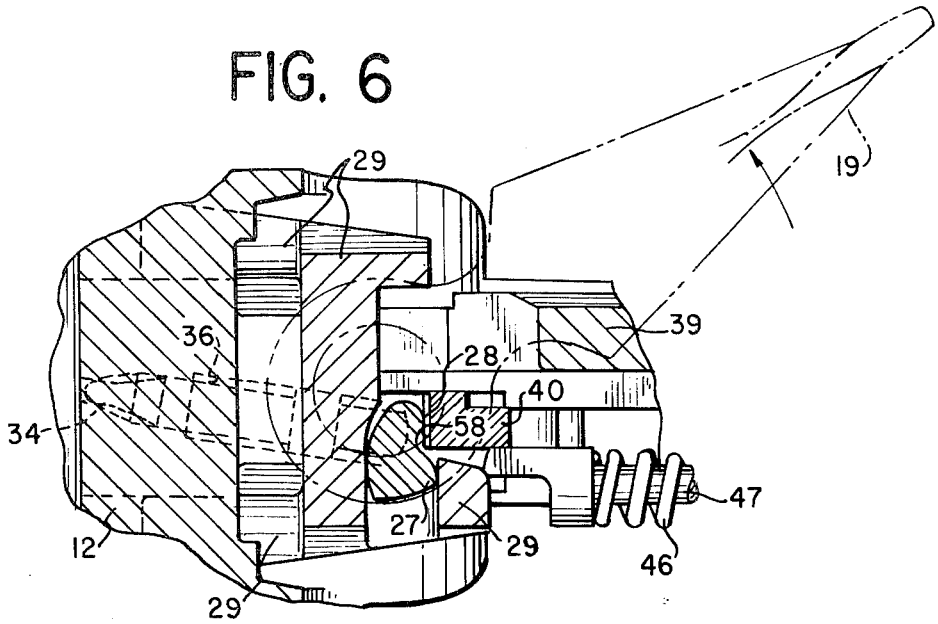
FIG. 6 is a sectional view similar to FIG. 4 showing the top lever and retracting cam at its barrel unlocking position.
Figure 5:
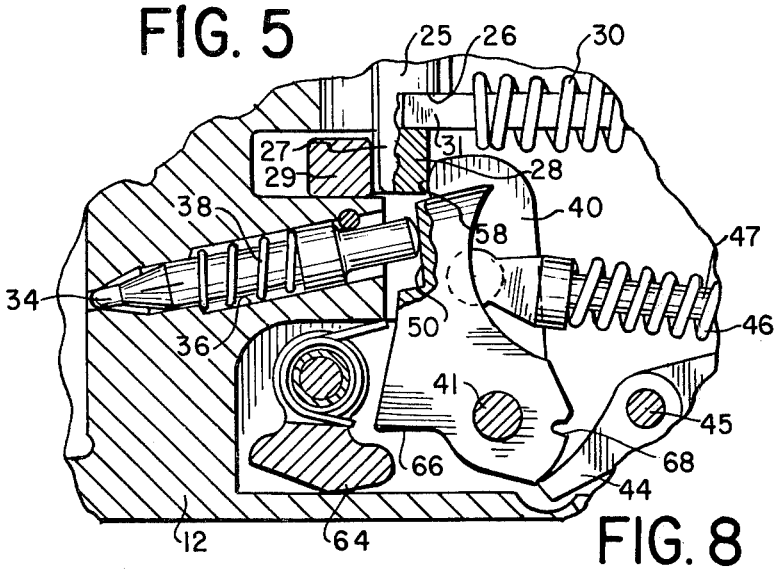
FIG. 5 is a sectional view similar to FIG. 3 showing the position of the lower hammer, the lower firing pin and the retracting cam of the top lever when the top lever is at its barrel unlocking position.

In the embodiment of the firing pin retractor means shown in FIGS. 2 through 6 of the drawings, the retractor cam 28 is located with respect to the lower hammer 40 so that the lower hammer is free to contact the rearward end of the lower firing pin 34 and to press the firing pin 34 forwardly to its forwardmost position when the top lever 19 is at its barrel locking position as shown in FIGS. 2 through 4; and it is located so that it will contact the hammer retracting cam surface 58 of the lower hammer 40 and move the lower hammer rearwardly a short distance when the top lever 19 is rotated to its barrel unlocking position as shown in FIGS. 5 and 6. Movement of the lower hammer 40 a short distance rearwardly permits the firing pin spring 38 of the lower firing pin 34 to move the firing pin to its rearwardmost position out of contact with the cartridge contained in the lower barrel 14, as also shown in FIGS. 5 and 6.

Figure 8:
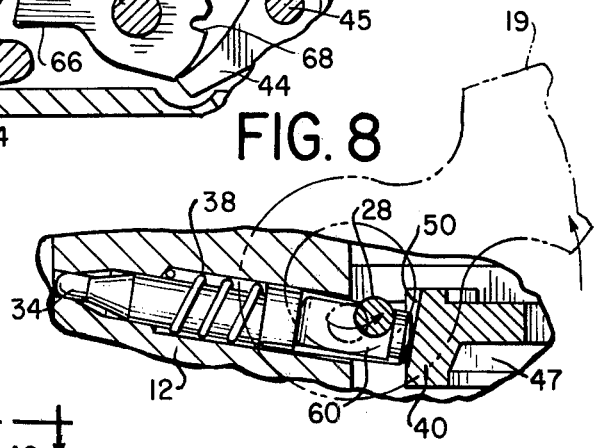
FIG. 8 is a sectional view along line 8—8 of FIG. 7.
Figure 7:
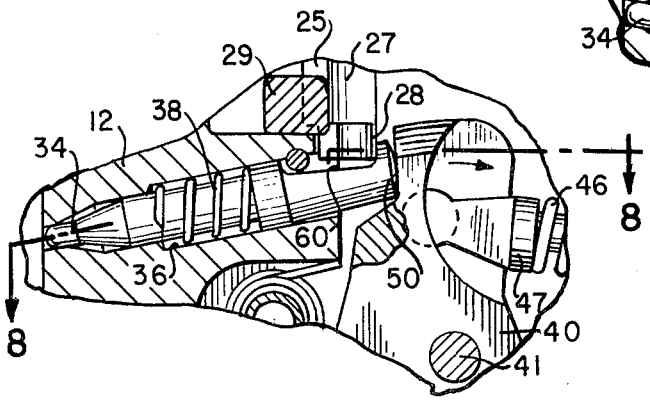
FIG. 7 is a fragmentary sectional view similar to FIG. 5 of a modification of the firing pin retracting means showing the positions of the firing pin, lower hammer and retracting cam of the top lever when the top lever is at its barrel locking position.

In the embodiment of the firing pin retractor means shown in FIGS. 7 and 8, the lower firing pin 34 is formed with a retractor cam receiving slot 60 in which the retractor cam 28 of the top lever 19 is received. The retractor cam 28 is received in the retractor cam receiving slot 60 and is positioned with respect to the slot 60 and the lower firing pin 34 so that the lower firing pin is free to move to its forwardmost position or to its rearwardmost position without interference by the retractor cam 28 when the top lever 19 is at its barrel locking position. Moreover, when the firing pin 34 is at its forwardmost position and the top lever 19 is at its barrel locking position, the retractor cam 28 is disposed adjacent the rearward end of the retractor cam receiving slot 60 so that when the top lever 19 is rotated from its barrel locking position to its barrel unlocking position the retractor cam 28 moves the lower firing pin 34 rearwardly out of contact with a cartridge contained in the lower barrel 14, as shown in FIGS. 7 and 8. At the same time the lower firing pin 34 moves the lower hammer 40 a short distance rearwardly against the pressure of the hammer spring, as also shown in FIGS. 7 and 8.

The top lever 19 must be rotated approximately 35° from its barrel locking position to its barrel unlocking position before the barrel lock bolt 29 is fully withdrawn from engagement with the barrel housing 15 and before the barrels 13 and 14 are free to rotate to their open position. The retractor cam 28 of the top lever 19 moves the lower hammer 40 rearwardly and withdraws the lower firing pin 34 from contact with the cartridge contained in the lower barrel 14 well before the top lever 19 has completely withdrawn the barrel lock bolt 29 from engagement with the barrel housing 15, thereby insuring that the lower firing pin 34 is at its rearwardmost position where it will not interfere with the movement of the upper and lower barrels 13 and 14 to their open position.

Figure 9:
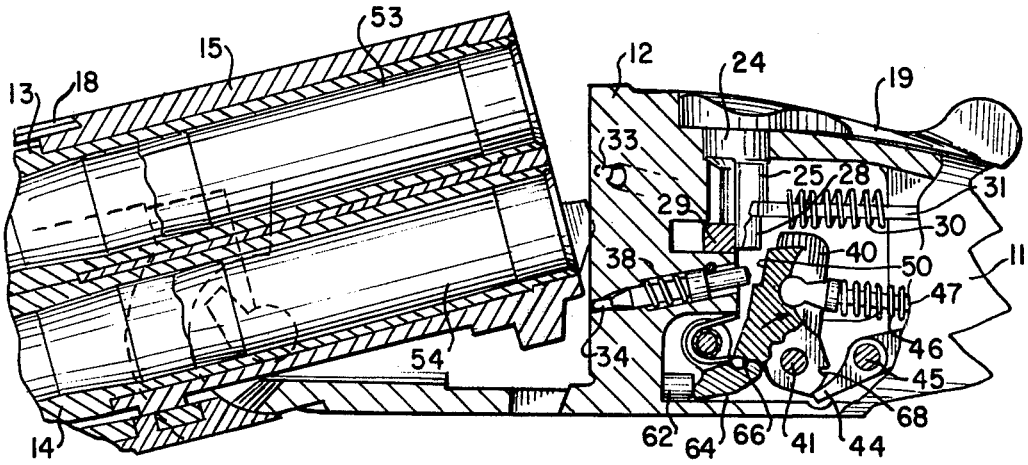
FIG. 9 is a fragmentary sectional view similar to FIG. 2 showing the barrels being rotated from their closed position to their open position.

When the upper and lower barrels 13 and 14 are moved to their open position as shown in FIG. 9, the hammer cocking push rod 62 for the lower hammer 40 is forced rearwardly against the hammer cocking cam 64 which, in turn, is rotated rearwardly and upwardly against the cocking cam surface 66 of the lower hammer. The lower hammer 40 is thus rotated to its rearward position at which position the lower hammer sear 44 engages the sear notch 68 of the lower hammer 40 and retains the hammer at its rearward cocked position. A similar arrangement of hammer cocking push rod and hammer cocking cam for the upper hammer 39 causes the upper hammer to be cocked when the barrels are rotated to their open position. After the upper and lower barrels are reloaded with fresh cartridges, the barrels are rotated to their closed position and are retained at this position by the barrel lock bolt. As the upper and lower hammers are at their cocked position, the shotgun is again ready to be fired.

We claim:

1. In an over-and-under break-open fire-arm having a frame; upper and lower barrels secured together and pivotally mounted on the frame for rotation from their closed ready-to-fire position to their open loading-and-unloading position; upper and lower firing pins mounted for longitudinal movement on the frame, the forward ends of said upper and lower firing pins extending, respectively, into the rearward ends of the upper and lower barrels at the longitudinal axes thereof when said firing pins are at their forwardmost positions, said firing pins being withdrawn from the rearward ends of said upper and lower barrels when said firing pins are at their rearwardmost positions; upper and lower firing pin springs urging said firing pins toward their rearwardmost positions; upper and lower hammers pivotally mounted on the frame, said hammers contacting and pressing the upper and lower firing pins to their forwardmost positions when said hammers are at their forward positions; upper and lower hammer springs urging said hammers toward their forward positions; and a top lever pivotally mounted on the frame for rotation about its vertical axis from a barrel locking position to a barrel unlocking position, said barrels being retained at their closed position when the top lever is at its barrel locking position and being rotatable to their open position when the top lever is at its barrel unlocking position; the improvement in means for retracting the lower firing pin from contact with a cartridge contained in the lower barrel which comprises:

a hammer and firing pin retracting cam disposed on the top lever at the lower end thereof, said retracting cam being radially offset with respect to the vertical axis of the top lever and being positioned to permit the lower hammer to contact and press the lower firing pin forwardly when the top lever is at its barrel locking position and being positioned to contact the lower hammer and to move it rearwardly when the top lever is rotated from its barrel locking position to its barrel unlocking position, thereby permitting the lower firing pin spring to move the lower firing pin rearwardly and thus withdraw it from the rearward end of the lower barrel.

2. The firearm according to claim 1 in which the upper and lower barrels are adapted to contain cartridges having primer caps at the rearward ends thereof, in which the forward ends of the upper and lower firing pins are positioned to contact and depress the primer caps of cartridges contained in said upper barrel and said lower barrel when said firing pins are at their forwardmost positions, said firing pins being withdrawn from contact with the primer caps of said cartridges when said firing pins are at their rearwardmost positions.

3. The firearm according to claim 1 in which the upper and lower hammers are disposed in side by side relationship with one of said hammers on each side of the longitudinal center line of the firearm, in which the upper firing pin extends longitudinally upwardly and inwardly from the forward facing firing pin striking surface of the upper hammer to the longitudinal axis of the upper barrel, and in which the lower firing pin extends longitudinally downwardly and inwardly from the forward facing firing pin striking surface of the lower hammer to the longitudinal axis of the lower barrel.

4. The firearm according to claim 1 in which a barrel lock bolt is slidably mounted for longitudinal movement on the frame, said barrel lock bolt engaging and retaining said barrels at their closed position when at its forwardmost position and releasing said barrels for rotation to their open position when at its rearwardmost position, and in which the top lever moves said barrel lock bolt from its forwardmost position to its rearwardmost position when said top lever is rotated from its barrel locking position to its barrel unlocking position.

* * * * *